US005291695A

United States Patent [19]

Healy et al.

[11] Patent Number: 5,291,695

[45] Date of Patent: Mar. 8, 1994

[54] SCAFFOLDING WITH ENCLOSED MOVABLE WORK AREAS SEALED AGAINST WORK SURFACES

[75] Inventors: Stephen M. Healy, Islington; Daniel W. Diverty, Burlington; Terrence F. Warren, Brantford, all of Canada

[73] Assignee: Blastco Corporation, Brantford, Canada

[21] Appl. No.: 971,205

[22] Filed: Nov. 4, 1992

[51] Int. Cl.[5] ..... B24C 3/00

[52] U.S. Cl. ..... 51/410; 51/426; 51/429

[58] Field of Search ..... 51/410, 424, 426, 429

[56] References Cited

U.S. PATENT DOCUMENTS

| | | | |
|---|---|---|---|
| 3,900,968 | 8/1975 | Shigyo | 51/410 |
| 4,199,905 | 4/1980 | Neidigh et al. | 51/429 |
| 4,649,672 | 3/1987 | Thomann | 51/424 |
| 4,825,598 | 5/1989 | Schlick | 51/410 |
| 4,949,512 | 8/1990 | Thomann | 51/426 |
| 5,011,710 | 4/1991 | Harrison | 51/426 |
| 5,038,527 | 8/1991 | Fastje | 51/426 |

*Primary Examiner*—Bruce M. Kisliuk
*Assistant Examiner*—Eileen P. Morgan
*Attorney, Agent, or Firm*—R. Craig Armstrong

[57] ABSTRACT

A scaffolding enclosure for use with large structures such as water towers and the like is described. The scaffolding has a modular construction and is adapted to provide one or more enclosed work areas against the walls of the structure. The scaffolding has a movable horizontal top module, preferably extending from one side of the structure to the other, and a vertical module at one end or preferably both ends of the horizontal top module, extending downwardly therefrom adjacent the wall of the structure. Each vertical module has at least one work area and is enclosed on the back and the sides. The front face is open to the wall of the structure, and the edges of the work area are sealed against the wall of the structure. For water towers with undercut lower walls, inwardly angled lower modules may be attached to the vertical modules, the lower modules also having at least one work area.

8 Claims, 14 Drawing Sheets

SCAFFOLDING WITH ENCLOSED MOVABLE WORK AREAS SEALED AGAINST WORK SURFACES

BACKGROUND OF THE INVENTION

1. Field of the Invention

This invention relates generally to apparatus for blasting, painting or otherwise treating the walls of large structures such as water towers, petroleum storage tanks, warehouses, factories, etc., and particularly to apparatus used to create a substantially sealed mobile work enclosure against the walls of such structures.

2. Description of the Prior Art

There is a growing consciousness regarding the environment and, in an attempt to protect the environment, the use and handling of certain materials is controlled.

Traditionally, blast cleaning operations were conducted in the open allowing the blast media and waste materials to become airborne and fall unheeded anywhere. Since the blast media is blown against the structure at high pressure, the blast media and waste material if not contained would fall over a large area and in high winds that area would be even larger. Such contamination is undesirable and accordingly many jurisdictions have imposed regulations to ensure that the blast media and waste materials are contained. Furthermore, some of the materials which are being removed are considered hazardous, such as lead-based paint, and it is therefore important to ensure that they are contained when removed.

In order to meet the requirements to contain the blast media and waste material, a number of systems have been proposed, including totally enclosing the structure, enclosed movable platforms, movable remote cleaning units, and hand-held vacuum blasters. These systems, however, are often difficult to use, costly and/or time-consuming to implement.

In prior art systems, in order to totally enclose a water tower, for example, a tarpaulin assembly has been used. The tarpaulin assembly includes a sock portion, a hat portion and supporting means. The supporting means includes a plurality of upper supports which are installed on the water tower, which is time-consuming. A plurality of supporting ropes are attached to the upper supports and the sock portion of the tarpaulin. The sock portion is then pulled up the side of the water tower. The hat portion of the tarpaulin which covers the top of the water tower is then attached to the sock portion. This tarpaulin assembly is very time-consuming and cumbersome to install and remove. It cannot be used in high winds since the wind load on the tarpaulin greatly increases the load on the water tower. Accordingly, in high winds the sock portion must be dropped and the work must be stopped even in only moderately high winds such as 20 miles per hour, so that there is enough time for the workers to get out and drop the sock before the wind increases further. Other problems include that it is difficult to maintain a sealed connection between the sock portion and the hat portion of the tarpaulin. Furthermore, the tarpaulin itself is costly and is susceptible to being ripped by high winds, as the tarpaulin is raised and lowered against guide wires.

Prior art movable platforms having enclosed platforms for use in cleaning buildings include those shown in U.S. Pat. No. 4,649,672 issued to Thomann on Mar. 17, 1987; U.S. Pat. No. 5,038,527 issued to Fastje on Aug. 21, 1990; and U.S. Pat. No. 4,949,512 issued to Thomann on Aug. 13, 1991.

Prior art remote-controlled units include for example the unit shown in U.S. Pat. No. 4,825,598 issued to Schlick on May 2, 1989. Such units are complex and intricate machines which are expensive to build and maintain and labor intensive to operate. Accordingly, they are expensive to operate.

The prior art hand-held vacuum blasters are mobile hand-held machines which both blast and contain the blast media. The nozzle of the blaster forms a seal against the structure so that no blast media or waste material can escape into the air. The hand-held vacuum blasters are particularly appropriate for spot blasting but they are too time-consuming to use for a large structure.

Other surface treatments, such as painting or chemical treatment, also may require an enclosed work area against the wall of the structure. Even where such an enclosure is not mandatory, it may be desirable for worker convenience and/or safety.

Accordingly there is a need for an apparatus which can be adapted to provide an enclosed work area against the walls of large structures. The apparatus should be readily adaptable to structures of different sizes and shapes, and should be relatively easy to install. It is also important that it be able to travel along or around the walls of the structure easily.

SUMMARY OF THE INVENTION

Accordingly, it is an object of the invention to provide a movable enclosure which may be sealed against the wall of a structure, which may be assembled relatively easily, and which preferably may be readily adapted to structures of different shapes and sizes.

In the invention, a modular scaffolding is therefore provided, which is adapted for use with large structures such as water towers and the like. The modular scaffolding is enclosed to contain the blast media and waste material. The scaffolding has a horizontal top module and at least one vertical module releasably attached to an end thereof and extending downwardly therefrom adjacent to the wall of the structure. For towers with an undercut area, lower modules extend downwardly and inwardly from the vertical modules. The vertical and lower modules each have at least one work area and are fully enclosed. The side edges of each work area are sealed against the structure. The horizontal module is movable along or around the structure, so that the work areas may be moved along or around the walls of the structure.

Preferably, the modules each have a plurality of modular sections, so that the apparatus is readily adaptable to different sizes of structures.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
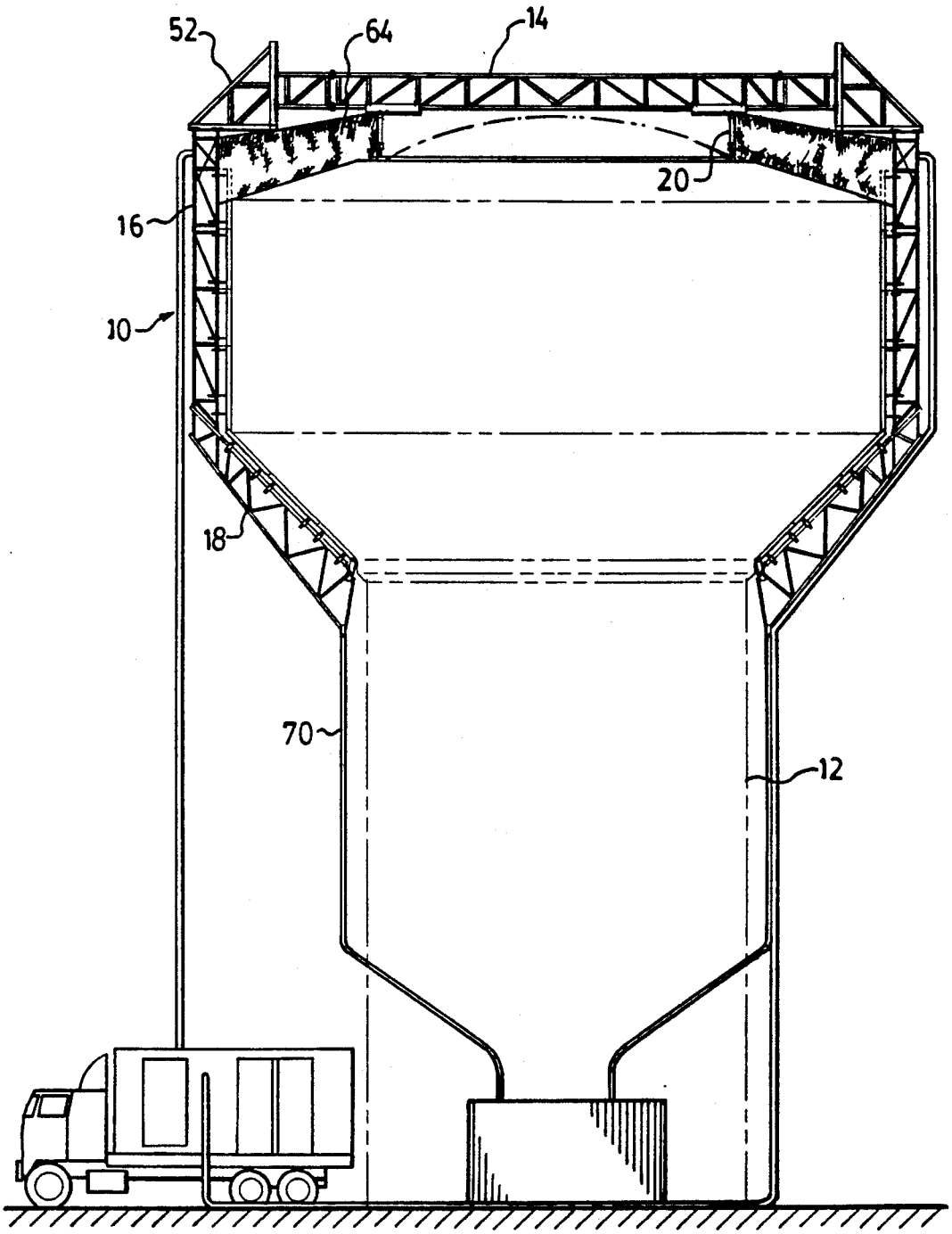
FIG. 1 is a side view of the scaffolding of the present invention with a water tower shown in phantom.
Figure 2:
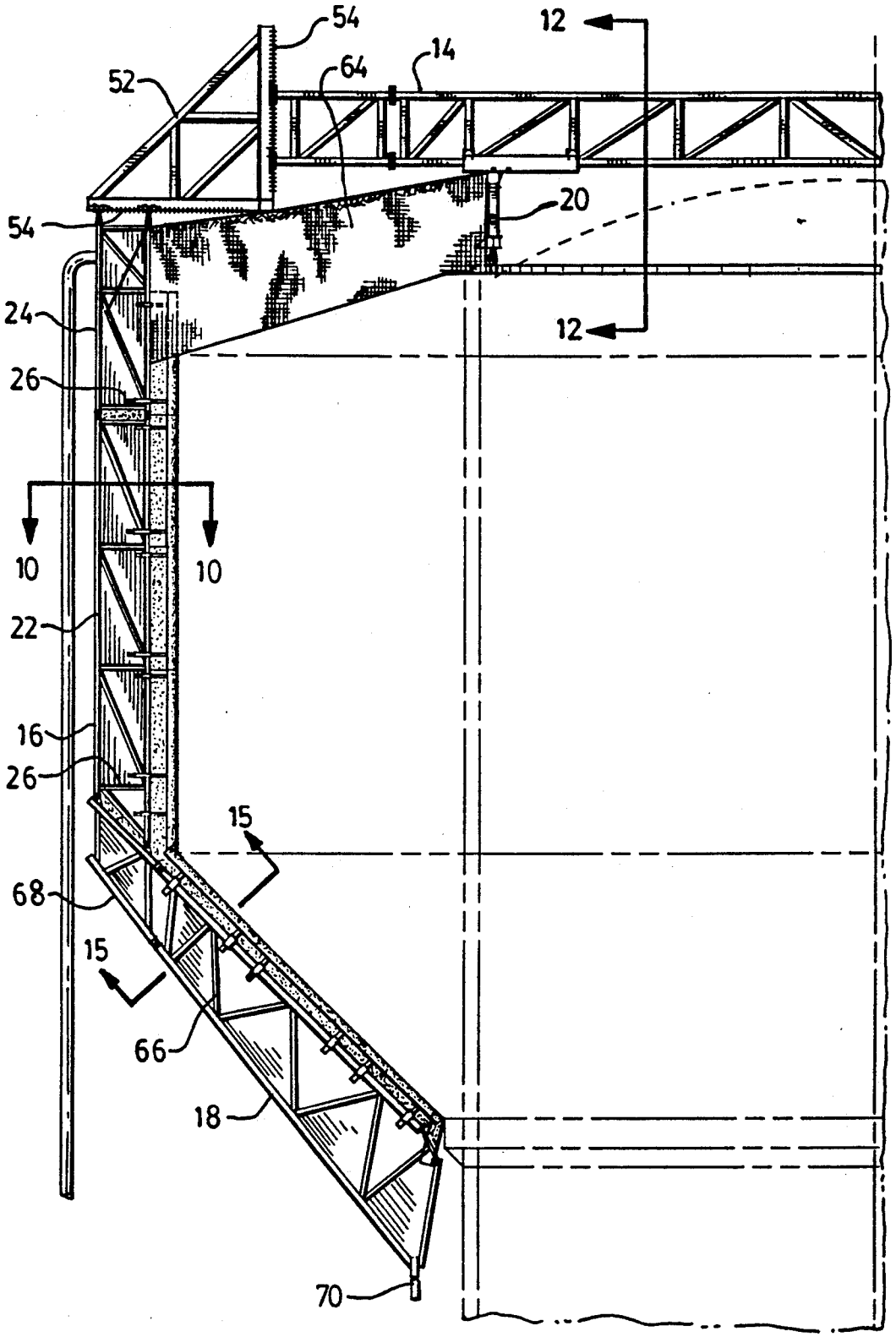
FIG. 2 is an enlarged side view of one side of the scaffolding.
Figure 17:
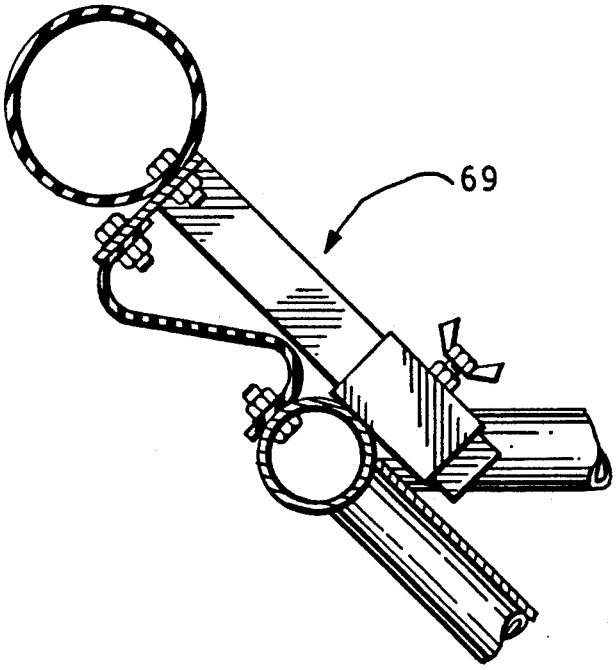
FIG. 17 is a sectional view of the sealing means of the lower module.
Figure 18:
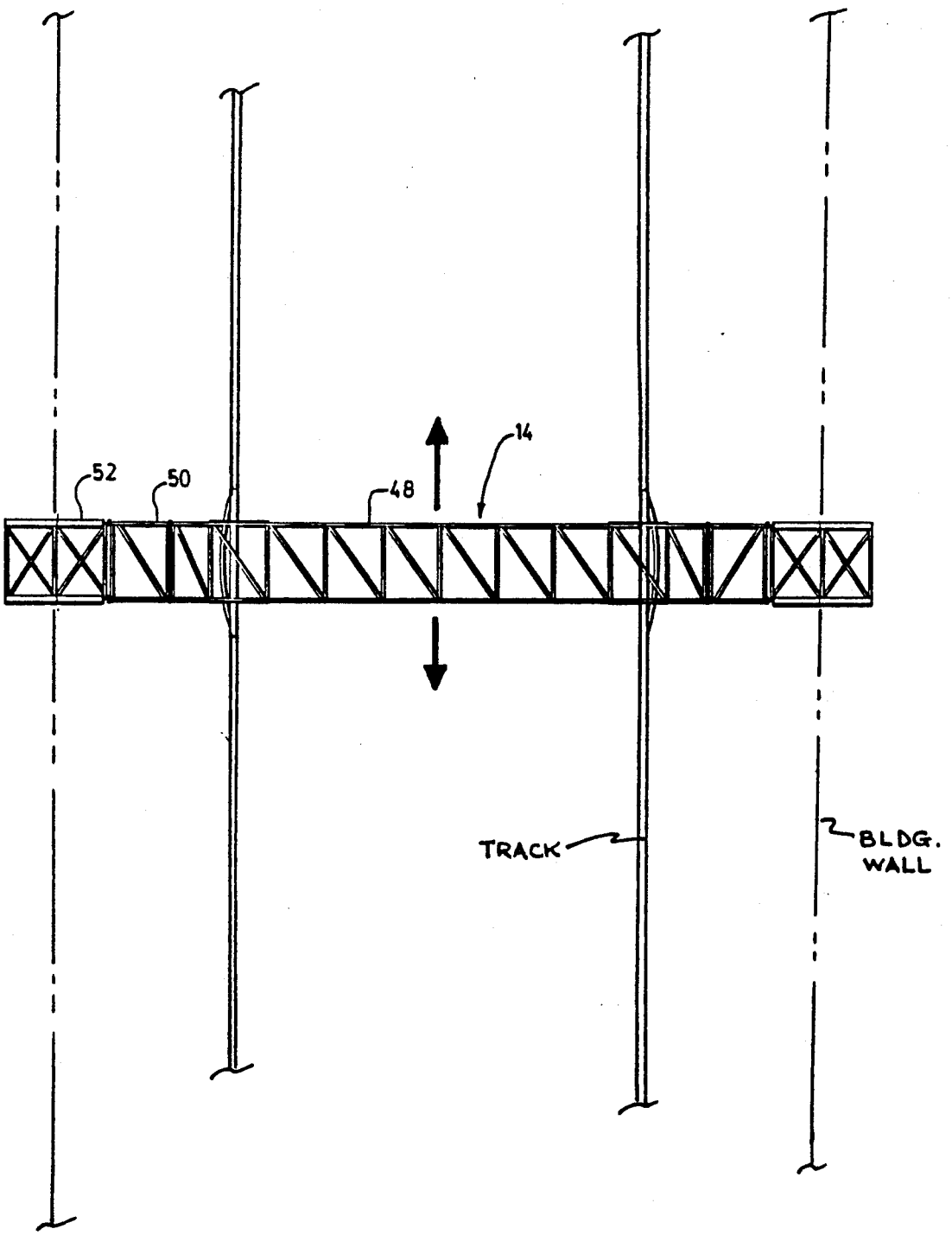
FIG. 18 is a plan view illustrating an adaptation of the apparatus for a rectangular structure.

Referring to FIG. 1, a blasting/painting scaffolding enclosure is shown generally at 10. The scaffolding 10 shown in FIGS. 1-17 is adapted to be used when blasting and painting or otherwise treating circular structures such as the water tower shown in phantom at 12. The scaffolding has a modular construction so that it can be used with towers of different shapes and sizes. FIG. 18 illustrates how the apparatus may be readily adapted for use with a rectangular structure such as a large warehouse or factory.

The scaffolding includes a horizontal top module 14, a pair of vertical modules 16, and for a tower of the type shown in the drawings, a pair of lower modules 18. The lower modules obviously may be dispensed with for structures having straight vertical walls. The horizontal top module is supported on and attached to a rotatable stand 20.

The pair of vertical modules each include a main vertical section 22, and a vertical extension section 24. The main section has three work areas. The extension section has one or more work areas, depending on the size of the tank. Each of the work areas has a work platform 26, a back 28 and two sides 30. The front is open to the water tower.

The back 28 of the work area is covered with corrugated steel and corrugated translucent fibreglass. The corrugated steel is for strength and the translucent fibreglass is to allow light into the work area.

A substantial portion of each side of each work area is a door 32 which can be opened and secured against the back when the blasting/painting operation is not taking place. During high winds the doors are opened, thereby reducing the wind load on the scaffolding.

Sealing means shown generally at 34 is attached to the front of each side. Any suitable means may be used, but in the preferred embodiment the sealing means includes a rubber hose 36, a slide bracket 38 and a flexible rubber sheet 40. The rubber hose is preferably 6 inch hose which is deformable under pressure. The slide bracket is attached to the rubber hose and the front of the side of the vertical module. By manipulating the slide bracket the rubber hose can be forced against the water tower and clamped into position. The rubber sheet extends between the rubber hose and the front of the work area. The size of the rubber sheet is determined by the slide bracket at its maximum extension and is flexible so that it can adapt to the different positions of the slide bracket.

Adjacent rubber hoses 36 butt against each and are taped together to form a continuous hose so that there can be a continuous seal against the water tower. Similarly adjacent flexible rubber sheets 40 butt against each other and are taped to form a continuous seal.

A bottom sheet 42 (FIG. 8) is a piece of rubber which extends down from the extension portion so that it overlaps the top of the lower adjacent main horizontal section. Similarly, a bottom sheet extends down from the main section and overlaps the adjacent lower section.

A ladder 44 is positioned on the inside of the work area to allow the workers to move from platform to platform. In general the inside edge of the work platform is approximately 18 inches away from the water tower to allow enough space for the workers to move from platform to platform.

Figure 3:
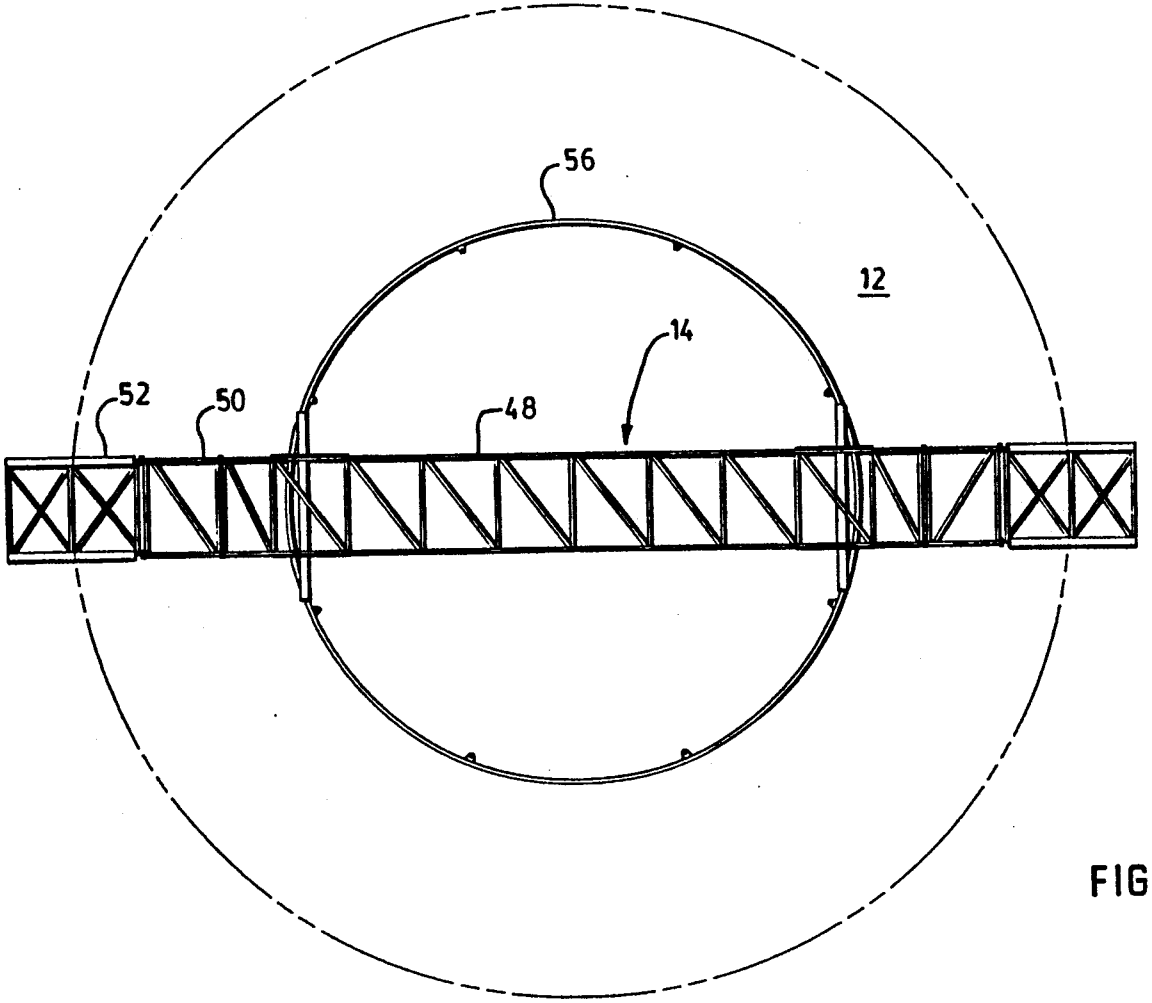
FIG. 3 is a top view of the scaffolding with a water tower shown in phantom.
Figure 4:
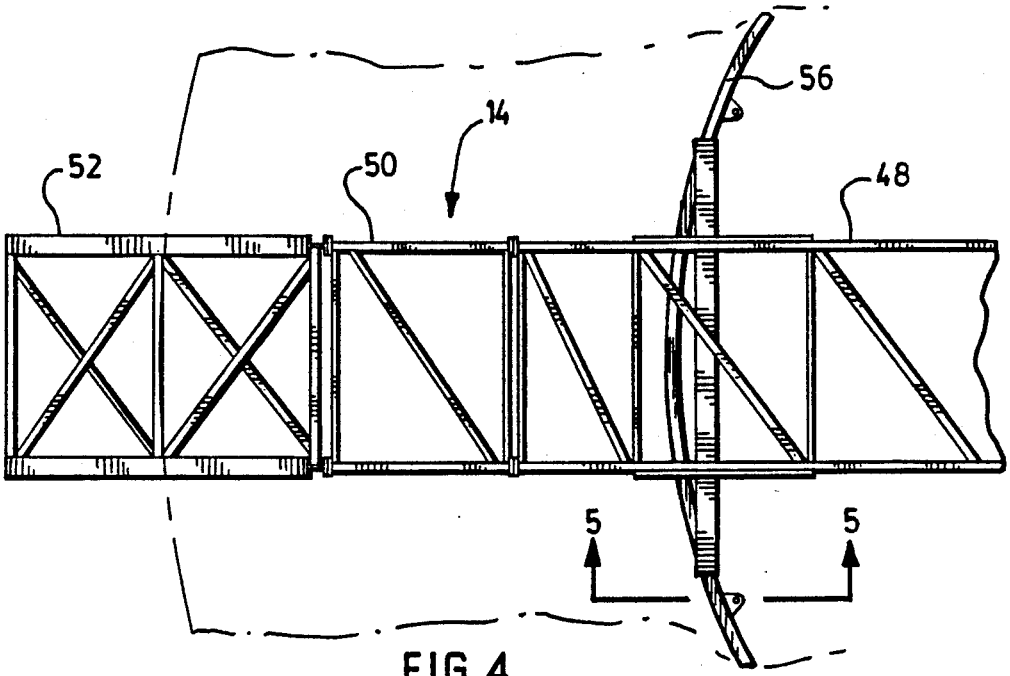
FIG. 4 is an enlarged top view of one side of the scaffolding.
Figure 5:
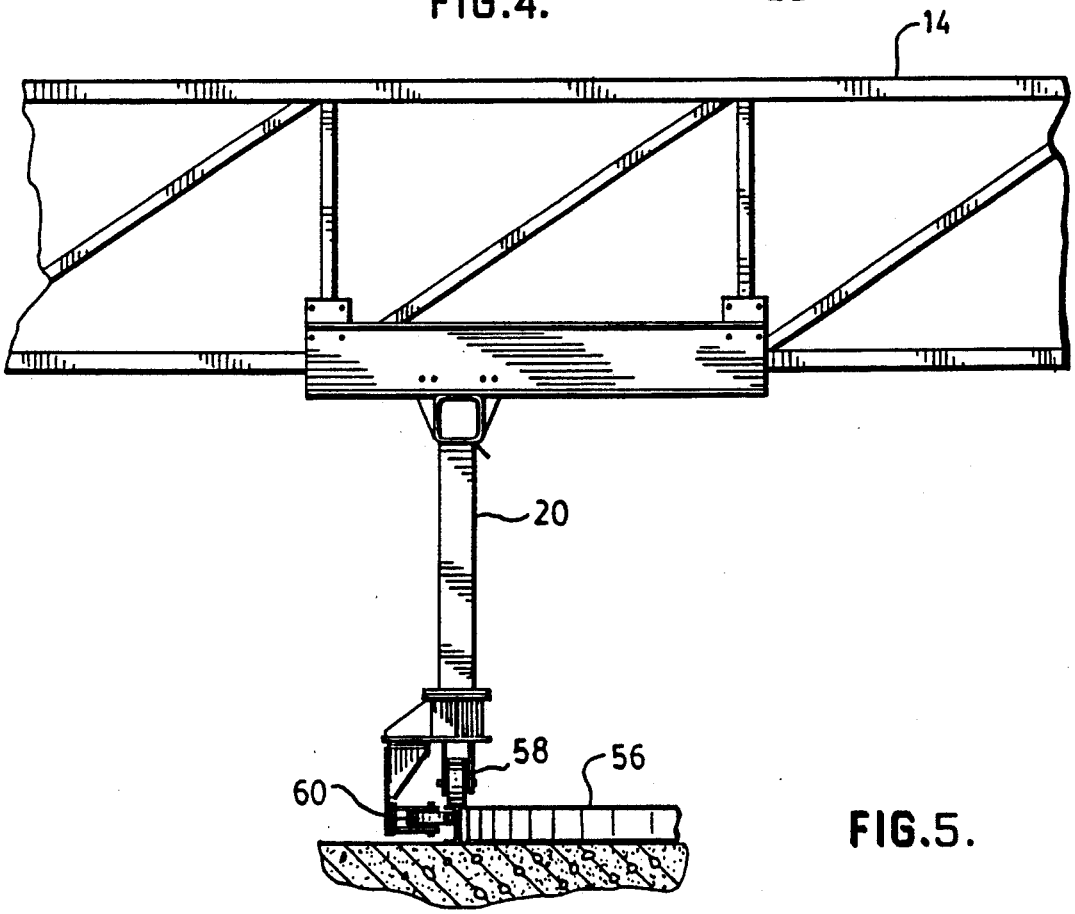
FIG. 5 in an enlarged side view as viewed from line 5—5 on FIG. 4.
Figure 6:
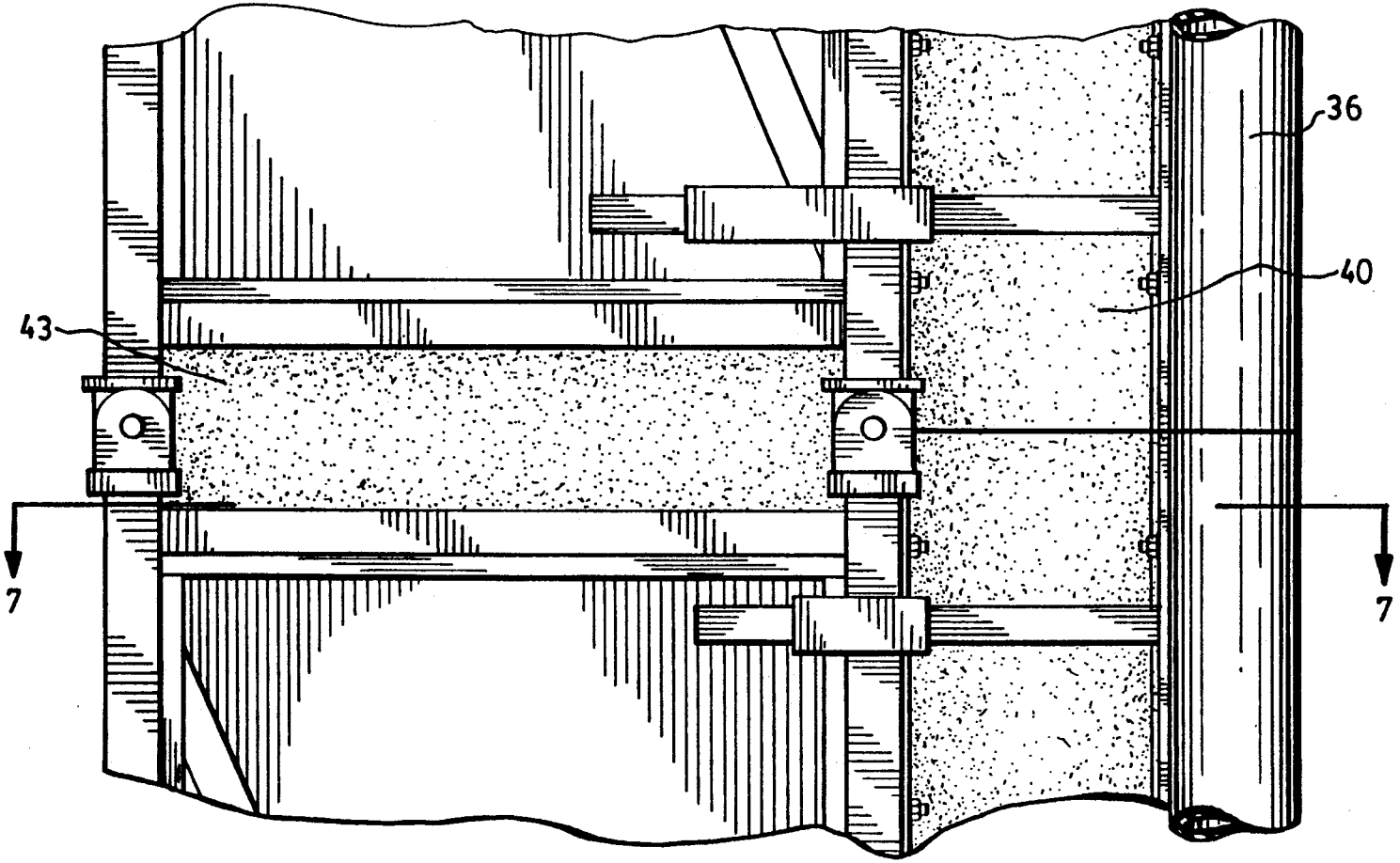
FIG. 6 is an enlarged side view of a portion of the vertical module of the scaffolding showing the connection between the main vertical section and the vertical extension section.
Figure 7:
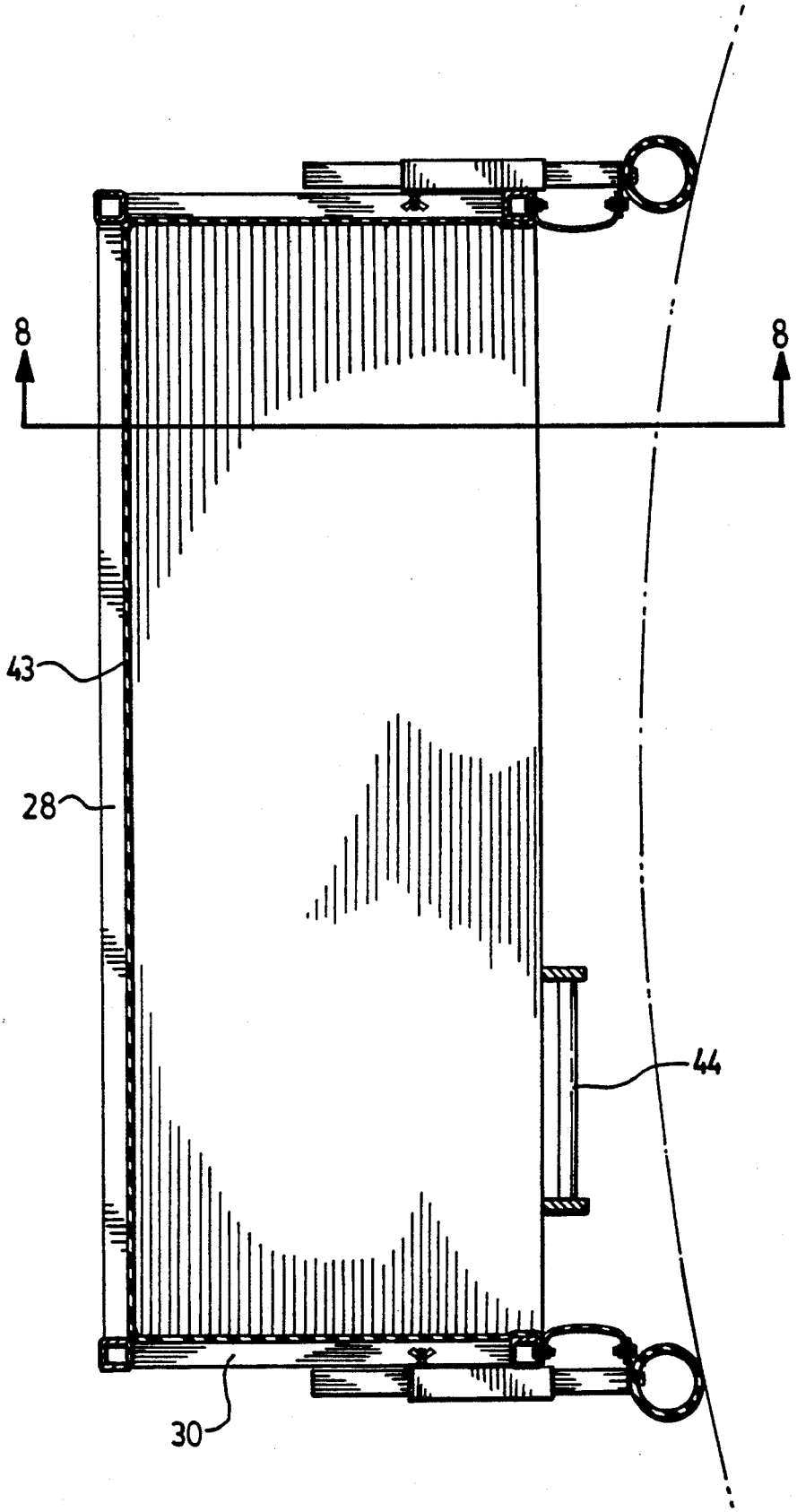
FIG. 7 is a horizontal sectional view taken along line 7—7 on FIG. 6.
Figure 8:
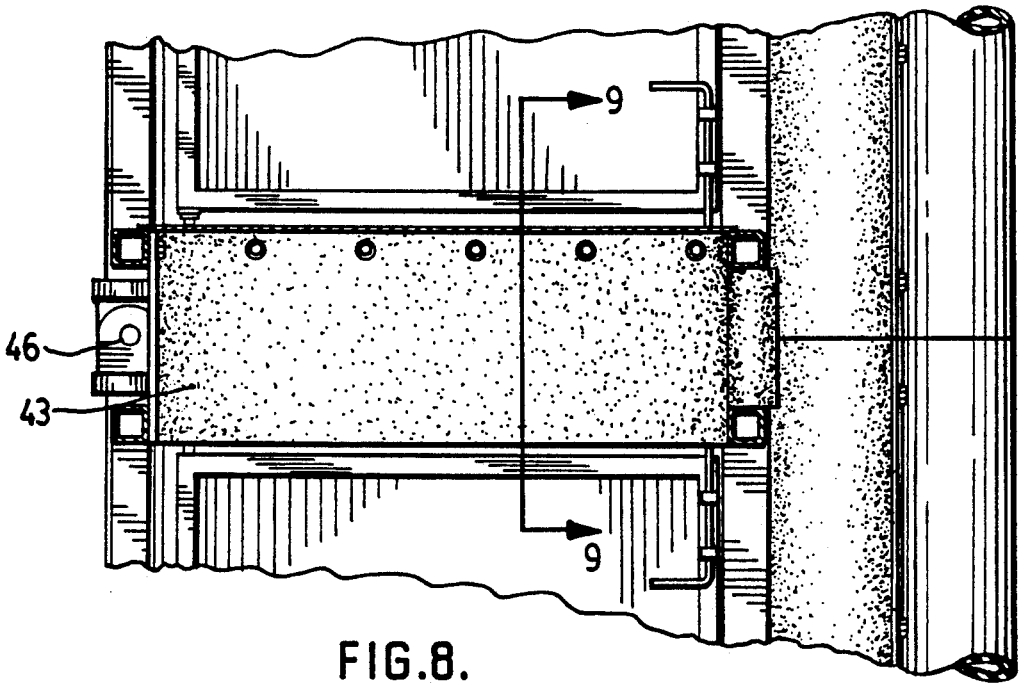
FIG. 8 is a vertical sectional view taken along line 8—8 on FIG. 7.
Figure 9:
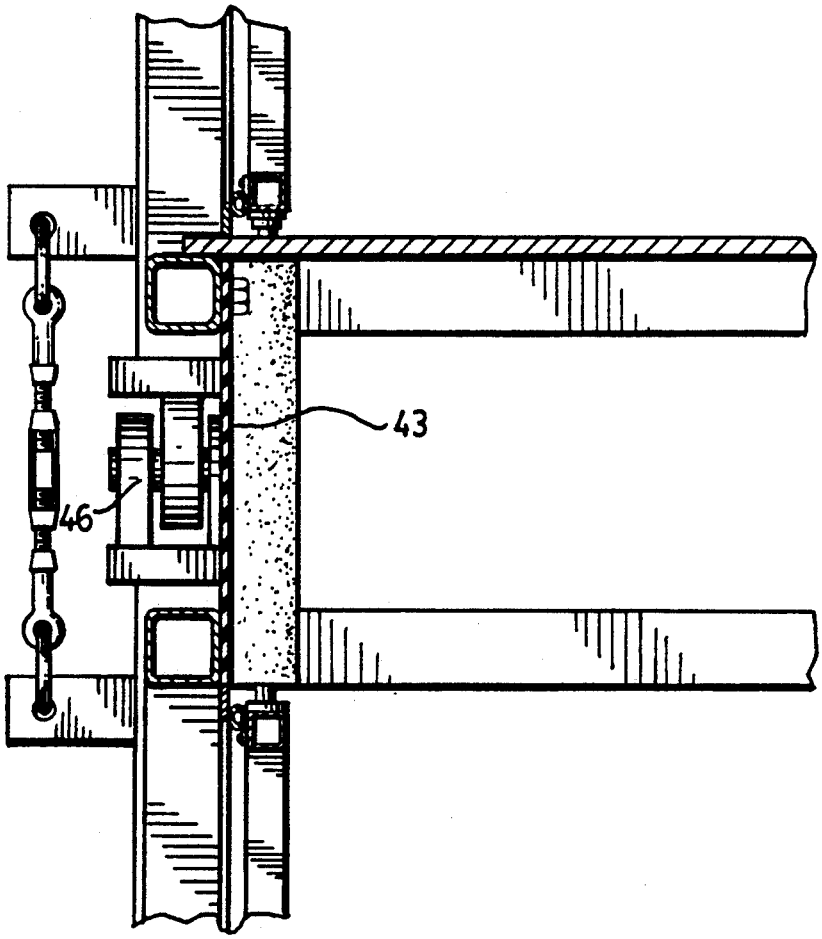
FIG. 9 is a vertical sectional view taken along line 9—9 on FIG. 8 showing the connection between the main vertical section and the vertical extension section.
Figure 10:
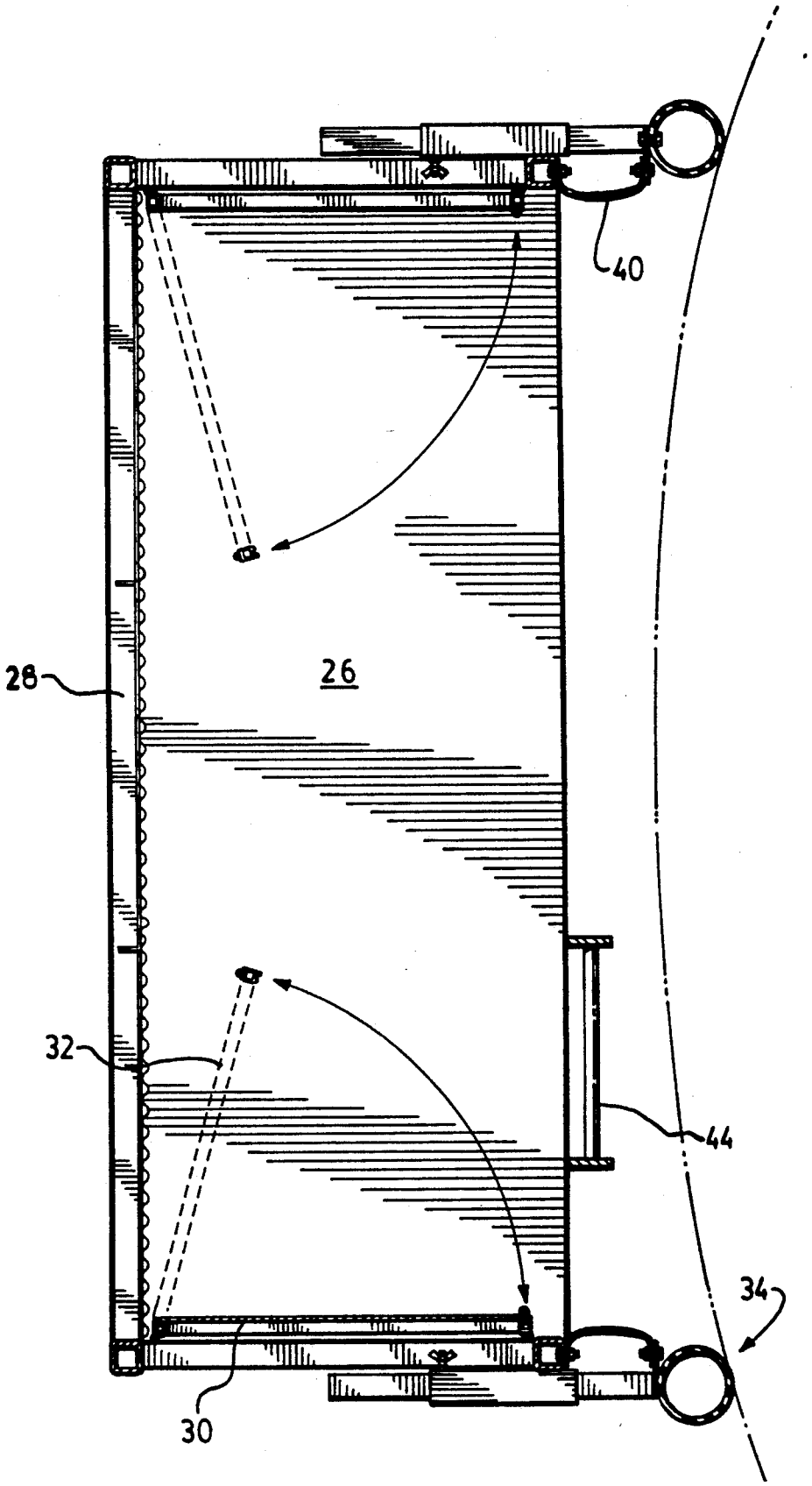
FIG. 10 is a horizontal sectional view similar to that shown in FIG. 7 and showing the doors.

The horizontal top module 14 shown in FIGS. 3 and 4 includes a main horizontal section 48 and a horizontal extension section 50. The main section is approximately 54 feet in length. This length is chosen to fit the typical small water towers, however a different length car be used if required to fit a particular structure. There are bolted connections 46 at each end of the main horizontal section. Similarly, there are bolted connections 46 at each end of the horizontal extension section.

A circular track 56 is attached to the top of the tower as shown in FIGS. 3, 12, 13 and 14. The track is a steel I beam. The diameter of the track is dependent on the size of the water tower. Since the track would not be visible from the ground it can be installed and the left there for future use. In general the track need not be removed.

Figure 12:
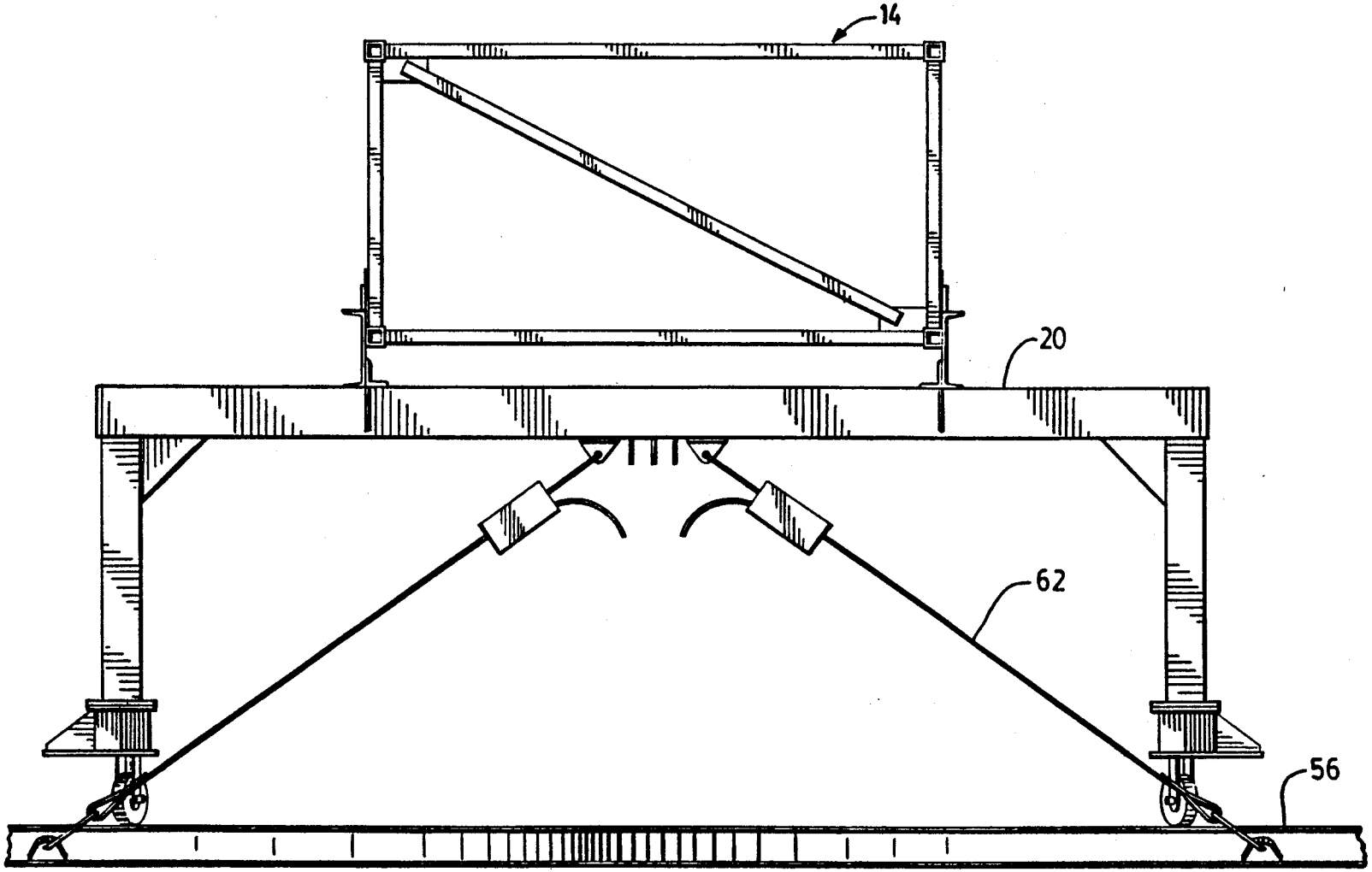
FIG. 12 is a sectional view of the top of the scaffolding showing the movable stand.
Figure 13:
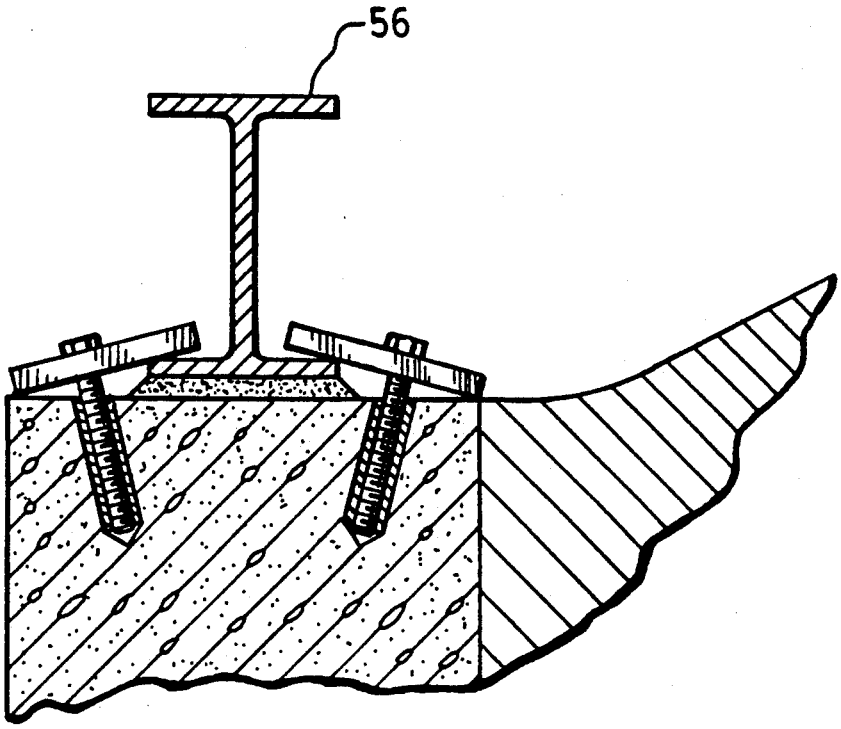
FIG. 13 is a sectional view of the track.
Figure 14:
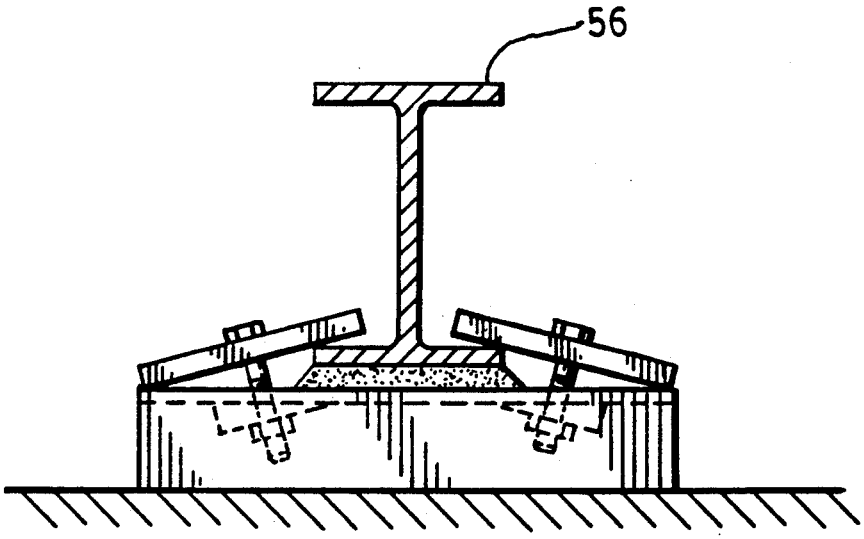
FIG. 14 is a sectional view of the track similar to that shown in FIG. 13 but taken at a different position.
Figure 15:
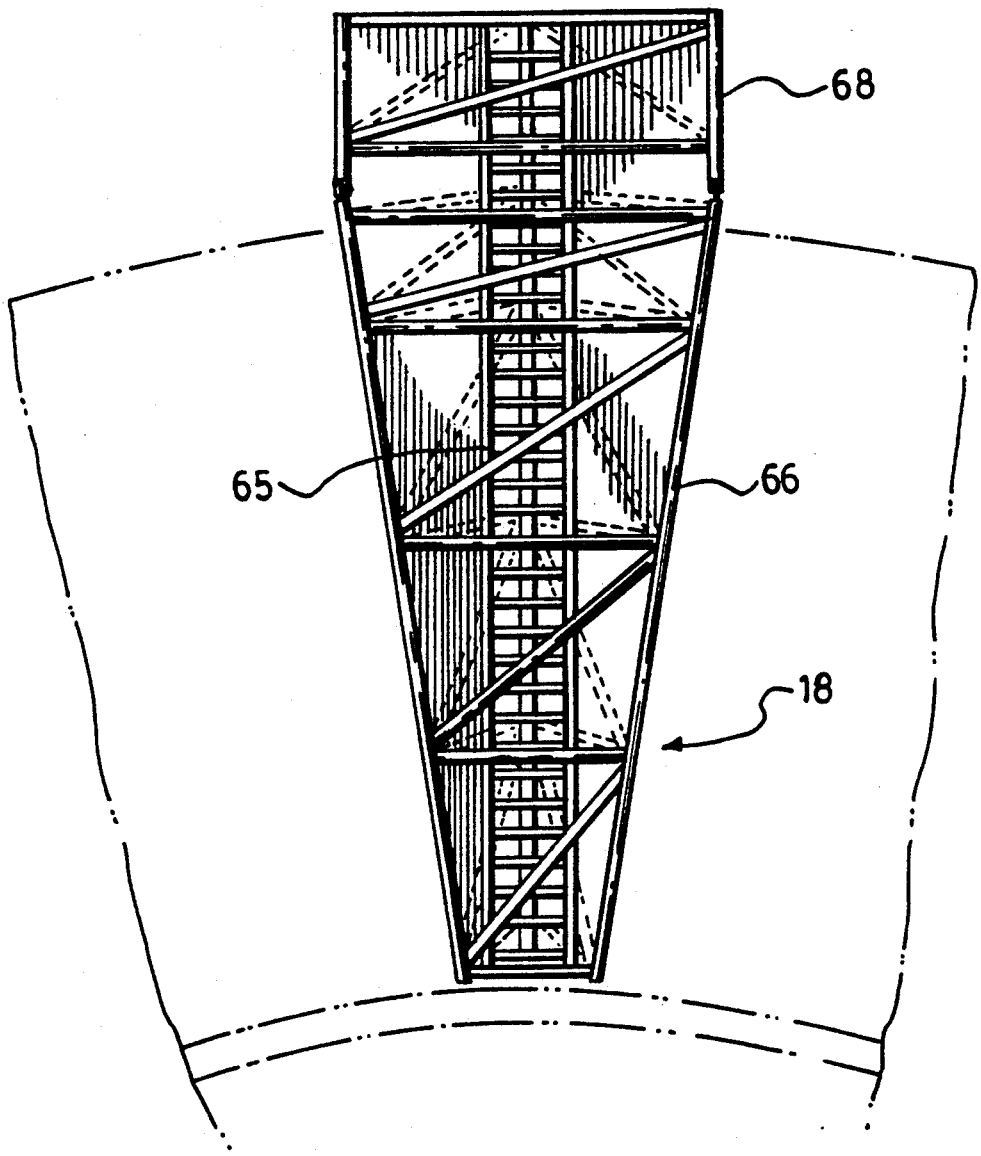
FIG. 15 is a top view of the lower module.
Figure 16:
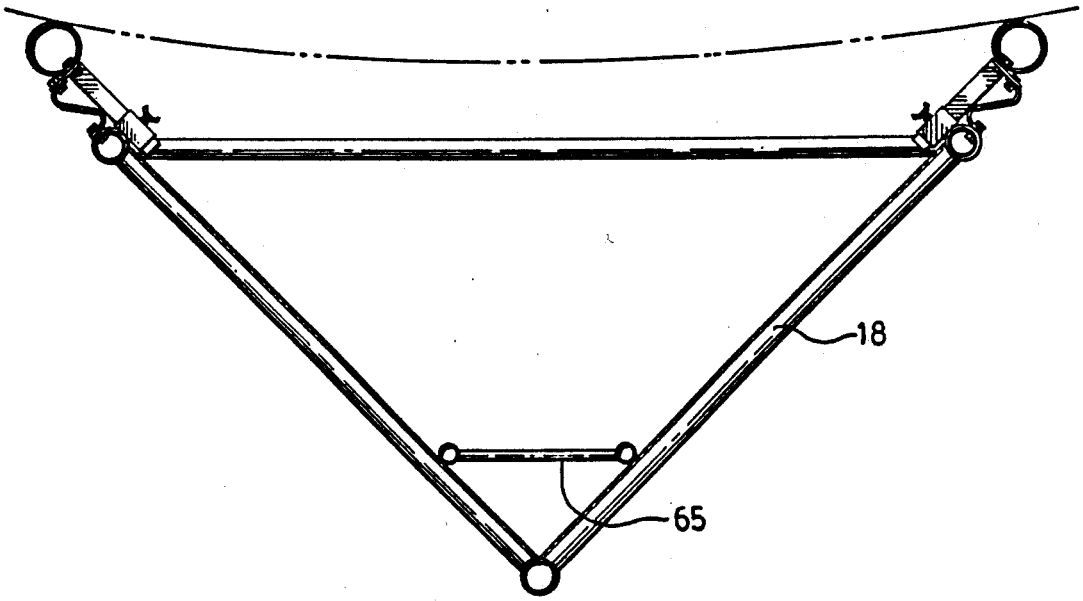
FIG. 16 is a sectional view of the lower module.

A movable stand 20, as best shown in FIG. 12, is positioned on the track 56. The stand is an inverted U-shaped structure with a pair of wheels 58 at the bottom of each leg. The top module 14 is attached to the stand. Each wheel is kept in position with a positioning wheel 60 which rests on the middle of the I beam and is attached to the wheel. The wheels 58 take the vertical load and the positioning wheels 60 take the thrust.

A pair of stays 62 hold the stand in position when the scaffolding is in position. The scaffolding is manually rotated between work positions with the aid of a Tirfer (trademark) or other cable grip tensioning device.

A tarpaulin 64 extends between the movable stand and the top of the vertical module 16. The lower portion of the tarpaulin is held in place by 6 inch blast hose filled with blast media which is placed on the lower portion of the tarpaulin and rests against the water tower. The upper portion of the tarpaulin is held in position by supports attached between the movable stand and the vertical module.

A corner module 52 is attached to the horizontal top module and the vertical modules and is adapted to provide for adjustment of the horizontal and vertical positioning of the vertical modules. A series of holes 54 at 3 inch centres are provided in the bottom and are positioned in registration with the bolted connections of the vertical module. The vertical module is attached to these holes and accordingly positioning of the vertical module can be adjusted in 3 inch increments. Similarly the front of the corner module has a series of holes 54 at 3 inch centres in registration with the bolted connections of the horizontal module. The horizontal module is attached thereto. Accordingly the vertical positioning of the vertical module can be adjusted in 3 inch increments.

The main vertical section is approximately 21 feet in height with the distance between work platforms of 6 feet 6 inches. The sides are 3 feet wide and the back is 8 feet long. The vertical extension section is approximately 11 feet in height. The door portion of each side of the vertical extension section is approximately 6 feet and there is a rubber sheet around the inside of the section above the door. The height of the main section is chosen to fit the height of a typical small water tower. Obviously, these dimensions can be varied to meet the particular requirements of the user.

There are bolted connections 46 at the top and bottom of each vertical section to attach it to the adjacent section or module.

This modular design permits the apparatus to be readily adapted for use with structures of different sizes, simply by adding or removing modules as required.

A lower module 18 extends downwardly and inwardly from the vertical module to provide access to the underside of the water tower. The lower module is generally V shaped with the depth of the V increasing in the downward direction and the width of the V decreasing in the downward direction. A ladder 65 is placed in the bottom of the V and the worker sits on the ladder.

The lower module has a main lower section 66 and a lower extension section 68. The bottom of the main vertical section 22 is angled so that it meets the slope of the lower module 18.

The main lower section has bolted connections at the back end thereof and bolted connections at the top of the outer end connectable to the bolted connections at the lower end of the vertical module. The extension lower section has bolted connections at the front end thereof connectable to the back end of the main lower section and bolted connections at the top thereof connectable to the bolted connection at the lower end of the vertical module.

Figure 11:
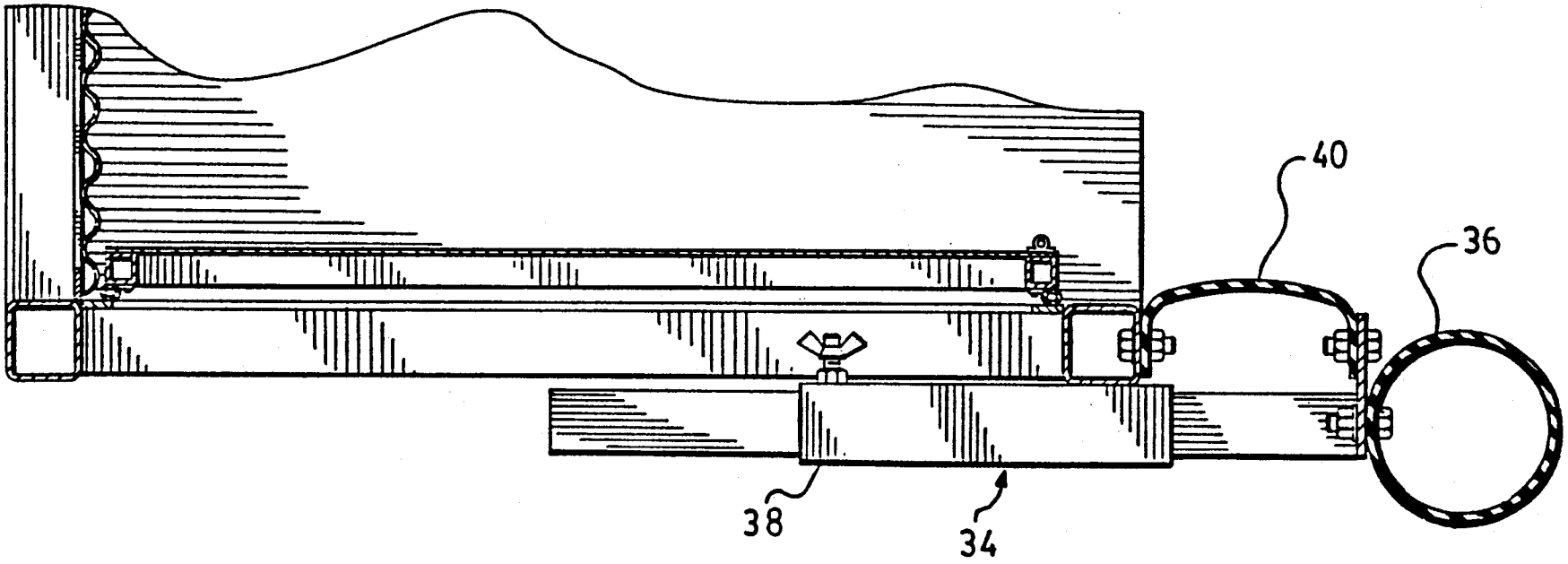
FIG. 11 is an enlarged horizontal sectional view showing the sealing means.

Steel sheets cover the inside of the lower module and the upper side is open to the water tower. Sealing means 69 similar to those described above are attached along the inside of the lower module. It will be appreciated that the flexible rubber sheet 40 of the sealing means can be attached so as to form an S shape as shown in FIG. 17 or a C shape as shown in FIG. 11.

A discharge hose 70 is attached to the lower end of the lower module. The lower module 18 basically acts as a funnel to funnel waste material into the discharge hose.

Preferably, during blasting at least a portion of the air in the enclosed work space is removed to further inhibit the escape of the blast material and the waste material. The blast material and the waste material will fall through the force of gravity to the discharge hose and be collected at the bottom of the water tower. The air in the work space is removed by a mobile dust collector.

The scaffolding is designed to support 3 workers on each side and to allow the blasting/painting operation to continue in wind speed up to 30 miles per hour. The scaffolding can withstand wind speeds of up to 50 miles per hour with the doors open.

It will be appreciated that the above description related to the preferred embodiment by way of example only. Many variations on the invention will be obvious to those knowledgeable in the field, and such obvious variations are within the scope of the invention as described and claimed, whether or not expressly described.

For instance the scaffolding could easily be adapted to cylindrical petroleum storage tanks by removing the lower module and adding vertical sections so that the vertical module is the appropriate length. Similarly the scaffolding could be adapted for use on water towers with a plurality of legs by removing the lower module and sealing the bottom of the vertical module and positioning a discharge hose there.

In addition the connection between the vertical module and the lower module could be varied so that the bottom of the vertical module is square thereby allowing for connection with other vertical modules in appropriate situations. Corresponding changes would then be made to the lower module for connection with the newly shaped vertical module by providing a wedge shaped portion adapted for connection with the vertical module and the lower module.

Furthermore, the scaffolding could be modified for use with a rectangular structure such as a typical warehouse or factory, by providing a straight track or tracks rather than circular track 56, as shown in FIG. 18.

It should also be appreciated that the horizontal module need not necessarily extend across the entire structure and have vertical modules at either end, although that is certainly preferable from a balance viewpoint. A movable horizontal module could be positioned on top of the structure, with a vertical module hanging from the outer end thereof, provided that sufficient structural support was provided. It should also be appreciated that in that case, the horizontal module may be very short, e.g. it could be only several feet long, i.e. just sufficiently long to engage some suitable rail or other support means on top of the structure or even at the edge of the structure. The claims are therefore not limited to the specific embodiments described above.

What is claimed as the invention is:

1. For use in blasting, painting or otherwise treating at least the vertical wall of a structure which is circular in cross-section and which has a central vertical axis, where said treatment is to take place in a substantially enclosed environment, a containment scaffolding comprising:

a generally horizontal module positionable on top of said structure and rotatable about said vertical axis, extending across said structure and having opposite end portions, at least one of which extends slightly outwardly beyond said wall;

a vertical module connected to and depending from at least one said extending end portion of said generally horizontal module, in close proximity to said wall, each said vertical module defining at least one work area adjacent said vertical wall, each said work area having enclosed top, bottom, rear and side faces and an open front face facing said vertical wall; and sealing mean at the edges of said open front face of each work area, adapted to contact the surface of said vertical wall and to effect a seal between said work area and said vertical wall.

2. A containment scaffolding as recited in claim 1, where there are two said vertical modules, one at each opposite end portion of said horizontal module.

3. A containment scaffolding as recited in claim 2, in which at least one of said horizontal and vertical modules comprises a plurality of modular sections connected together, whereby containment scaffoldings of various dimensions may be readily assembled.

4. A containment scaffolding as recited in claim 2, for use where said structure has an upper portion of generally constant diameter and a lower portion of decreasing diameter tapering downwardly therefrom, said containment scaffolding further comprising an angled lower module connected to each said vertical module and arranged to be positioned adjacent said decreasing diameter portion, each said lower module defining at least one work area adjacent said decreasing diameter portion, each said work area having enclosed outer faces and an open front face facing said decreasing diameter portion; and sealing means at the edges of said open front face of each work area, adapted to contact the surface of said decreasing diameter portion and to effect a seal between said work area and said decreasing diameter portion.

5. A containment scaffolding as recited in claim 4, in which at least one of said horizontal and vertical modules comprises a plurality of modular sections connected together, whereby containment scaffoldings of various dimensions may be readily assembled.

6. A containment scaffolding as recited in claim 1, for use where said structure has an upper portion of generally constant diameter and a lower portion of decreasing diameter tapering downwardly therefrom, said containment scaffolding further comprising an angled lower module connected to each said vertical module and arranged to be positioned adjacent said decreasing diameter portion, each said lower module defining at least one work area adjacent said decreasing diameter portion, each said work area having enclosed outer faces and an open front face facing said decreasing diameter portion; and sealing means at the edges of said open front face of each work area, adapted to contact the surface of said decreasing diameter portion and to effect a seal between said work area and said decreasing diameter portion.

7. A containment scaffolding as recited in claim 6, in which at least one of said horizontal, vertical and lower modules comprises a plurality of modular sections connected together, whereby containment scaffoldings of various dimensions may be readily assembled.

8. A containment scaffolding as recited in claim 1, in which at least one of said horizontal and vertical modules comprises a plurality of modular sections connected together, whereby containment scaffoldings of various dimensions may be readily assembled.

* * * * *